US006438762B1

(12) United States Patent
Jenkins

(10) Patent No.: US 6,438,762 B1
(45) Date of Patent: Aug. 27, 2002

(54) COVER FOR HELMET PADDING

(76) Inventor: David L. Jenkins, 109 Lynwood Dr., Edinboro, PA (US) 16412

( * ) Notice: Subject to any disclaimer, the term of this patent is extended or adjusted under 35 U.S.C. 154(b) by 0 days.

(21) Appl. No.: 09/881,286

(22) Filed: Jun. 14, 2001

(51) Int. Cl.[7] ..... A42B 3/00; A41D 27/26
(52) U.S. Cl. ..... 2/411; 2/267; 2/414; 2/425
(58) Field of Search ..... 2/411, 412, 267, 2/414, 181, 425, 909, 46

(56) References Cited

U.S. PATENT DOCUMENTS 3,577,562 A * 5/1971 Holt
3,600,713 A * 8/1971 Holt
3,673,609 A * 7/1972 De Simone
3,843,970 A * 10/1974 Marietta et al.
4,558,470 A * 12/1985 Mitchell et al.
4,916,759 A * 4/1990 Arai
5,337,420 A * 8/1994 Haysom et al.
5,657,492 A * 8/1997 Esposito, Jr.
6,185,753 B1 * 2/2001 Arai
6,192,519 B1 * 2/2001 Coalter

* cited by examiner

*Primary Examiner*—Rodney M. Lindsey
(74) *Attorney, Agent, or Firm*—Richard K. Thomson

(57) ABSTRACT

A protective cover made of absorbent, stretchable, high lubricity fabric for overlying cushioning frontal pads of helmets. The cover can absorb sweat and the high lubricity of the fabric will enable the helmet to be taken on and off numerous times without producing an abrasion on the wearer's skin.

3 Claims, 2 Drawing Sheets

COVER FOR HELMET PADDING

BACKGROUND AND SUMMARY OF THE INVENTION

The present invention is directed to a "slip cover" for the cushioning frontal pad in a football helmet, and the like, to reduce sliding friction and the abrasions created by the frontal pad.

In order to be effective, helmets, particularly football helmets, must be tight fitting to ensure the wearer's safety. Unfortunately, given the abrasive nature of the cushioning padding inside the helmet, this tight fit causes an abrasion on the wearer's forehead due to the large number of times the helmet is put on and removed. These abrasions are called "tattoos" and players frequently attempt to avoid them by use of a bandana or other protective wear to reduce the damage to the skin as the helmet is repeatedly donned and removed.

There are two principle manufacturers of helmets: Riddell and Schutt. The Riddell helmet employs a frontal pad that bears the name TRU-CURVE. It essentially is constructed as a tongue of padding that is folded back on itself into the helmet. The Schutt helmet employs a Schutt AIR Liner front sizer that can have any of a variety of shapes. The liner is an elongated element retained within the front portion of the helmet by VELCRO fabric.

The present invention comprises two different designs of a protective "slip cover" that is placed on the frontal pad of these two helmets. The cover is made of a stretchable, high lubricity fabric such as SPANDEX, LYCRA, nylon or RAYON. Most preferably, the protective cover is made of LYCRA which can be slipped over the frontal pad. Its slippery texture enables the helmet to be put on and removed with considerably less abrasion to the skin and eliminates or greatly reduces the occurrence of tattoos.

BRIEF DESCRIPTION OF THE DRAWINGS

The preferred embodiment(s) of the present invention is/are described in conjunction with the associated drawings in which like features are indicated using like reference numerals and in which.

DETAILED DESCRIPTION OF THE PREFERRED EMBODIMENT(S)

Figure 1:
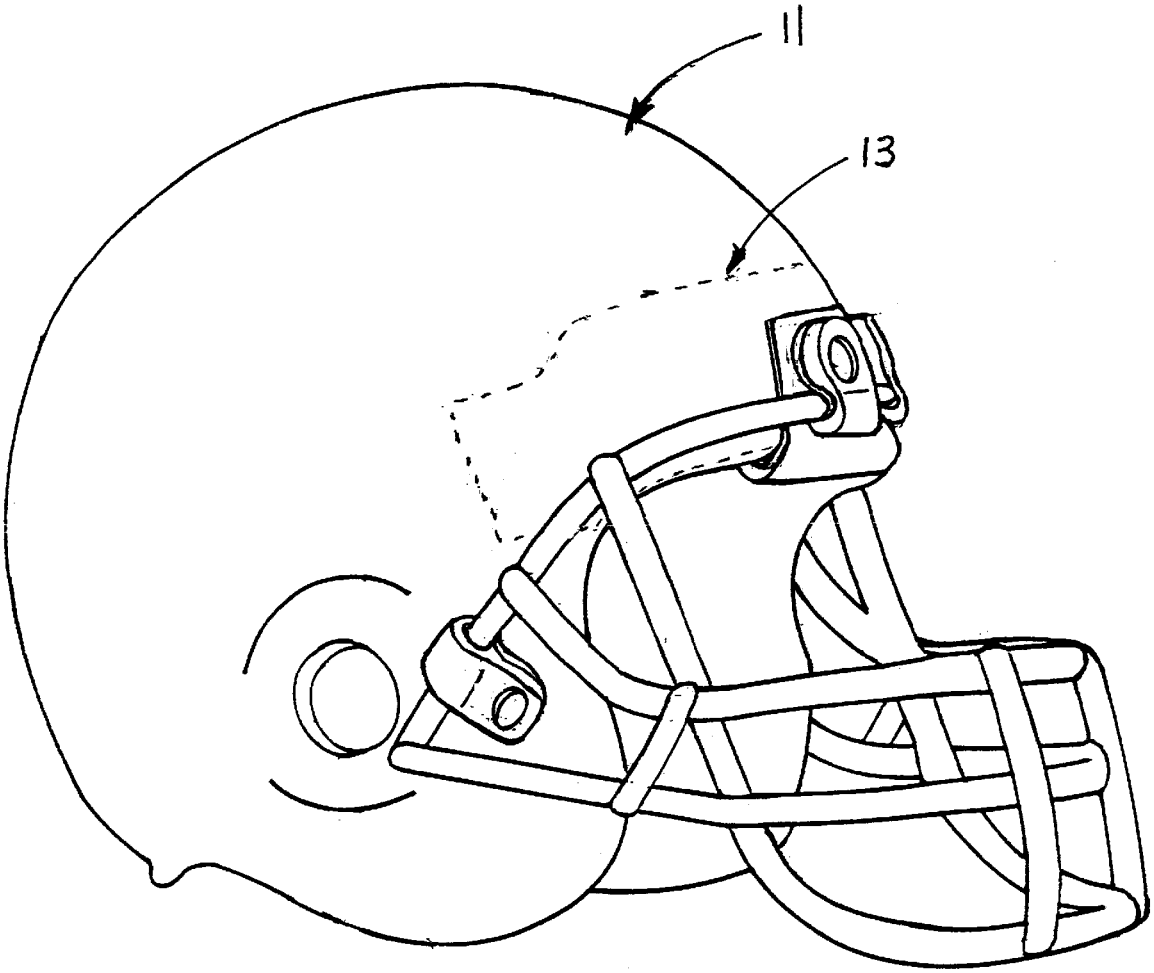
FIG. 1 is a perspective view of a football helmet of the type with which the protective cover of the present invention could be used.
Figure 2:
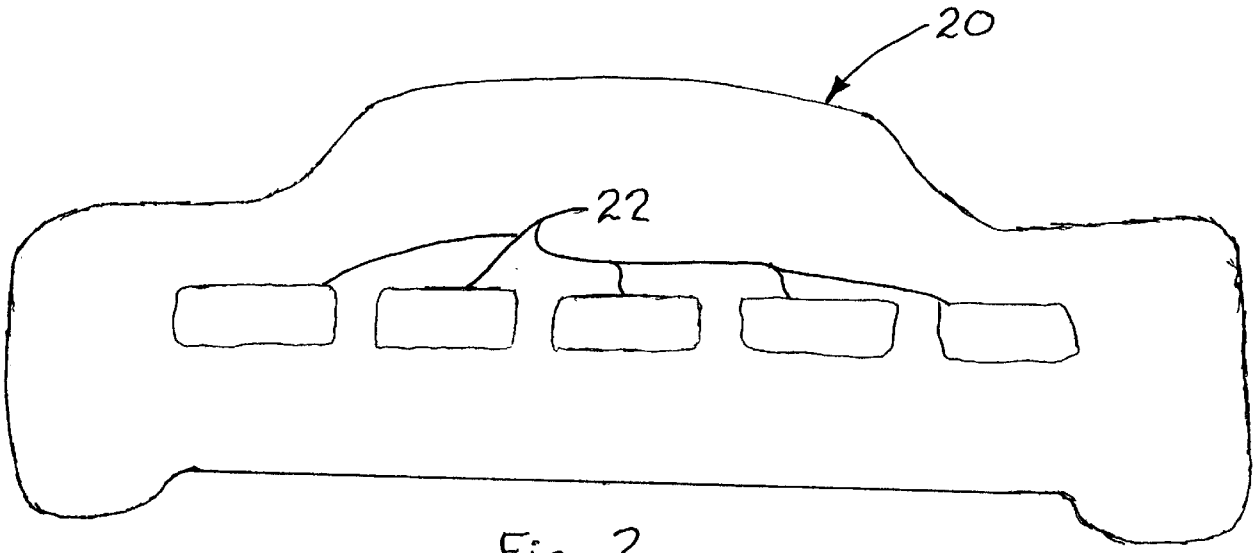
FIG. 2 is a front view of a first embodiment of the protective cover of the present invention.

A helmet 11 having a frontal pad 13 with which the protective cover of the present invention can be used is shown in FIG. 1. A first embodiment of the protective cover of the present invention is shown in detail in FIG. 2 generally at 20. Protective cover 20 comprises a slip cover of absorbent, stretchable, high lubricity fabric fashioned to fit over the frontal pad of helmet 11. While helmet 11 has been depicted as a football helmet, it will be appreciated that this invention may be used with any sort of helmet including auto racing, baseball cycling, deep sea diving, lacrosse, military aircraft pilots, motorcycling, etc. Protective cover 20 is fashioned as a form fitting cover made of a fabric that has the desirable characteristics and may be selected from the group consisting of SPANDEX, LYCRA, nylon, and RAYON. These materials can absorb sweat, are stretchable enough to allow the protective cover 20 to be slipped over the frontal pad 13, and have a high lubricity such that they slide well in contact with the skin so as not to create a friction-induced abrasion.

Protective cover 20 is formed with a plurality of openings 22 on its face that permit the VELCRO fabric strips attached to frontal pad 13 to protrude through and engage the complementary fabric strips that are attached within the helmet 11. Frontal pad 13 may be stuffed through any of the openings 22 and the enshrouded frontal pad 13 reinstalled in its operative position within the helmet by reengaging the halves of the VELCRO fabric.

Figure 3:
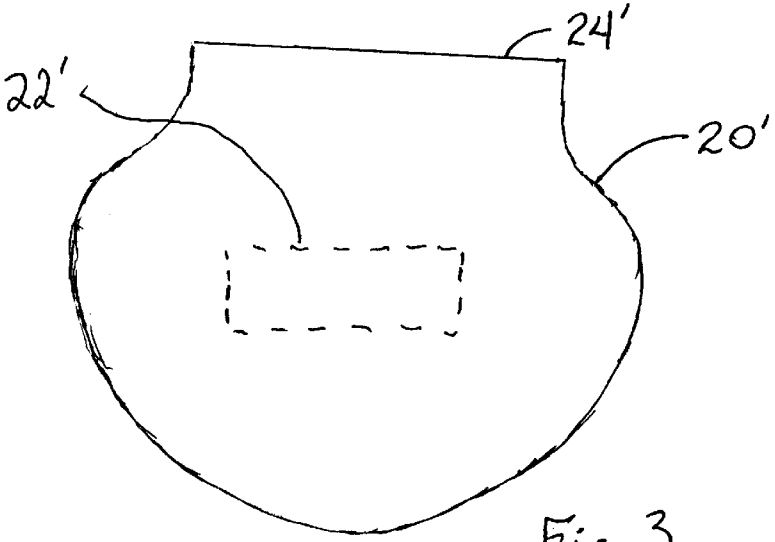
FIG. 3 is a front view of a second embodiment of the protective cover of the present invention.

A second embodiment of the protective cover of the present invention is shown in FIG. 3 at 20'. The configuration depicted here is designed to fit the Riddell TRU-CURVE frontal pad. The frontal pad, which is tongue like, may be extended from the helmet so that the open end 24' of the protective cover 20' may be slid over the distal end of the frontal pad. Protective cover 20' has an opening 22' on the back side so the VELCRO fabric on the frontal pad can adhere to the strip mounted within the helmet. The tongue like frontal pad with the protective cover 20' slipped there over may be doubled back on itself to be, once again, in its operative position within the helmet. Obviously, the protective cover 20, 20' can be configured to fit over a frontal pad regardless of its shape. This protective cover 20' will absorb sweat and the high lubricity of its fabric will allow the helmet to be pulled on and off the wearer's head without the padding causing an abrasion on her/his skin.

Various changes, alternatives and modifications will be come apparent to one of ordinary skill in the art following a reading of the foregoing specification. It is intended that all such changes, alternatives and modifications as fall within the scope of the appended claims be considered part of the present invention.

I claim:

1. In a helmet having a frontal pad of a particular configuration removably secured to an interior portion thereof, the improvement comprising a slip cover for said frontal pad, said cover made of an absorbent, stretchable, high lubricity fabric, said fabric shaped as a pocket to receive said frontal pad of the particular configuration, said pocket having an opening large enough to permit the frontal pad to be inserted there through, whereby when the frontal pad is inserted into said slip cover and reinserted in place, as the helmet is put on or removed from a wearer's head, said slip cover will reduce the friction between the padding and the wearer's head reducing and/or eliminating formation of an abrasion generally referred to as a tattoo.

2. The slip cover for a frontal pad of claim 1 wherein said fabric is selected from the group consisting of Spandex, Lycra, rayon and nylon.

3. The slip cover for a frontal pad of claim 1 further comprising openings formed in one surface of said slip cover to allow VELCRO fabric strips on the frontal pad to engage complementary VELCRO fabric strips mounted inside the helmet.

* * * * *